United States Patent [19]

Itoh et al.

[11] 4,161,765

[45] Jul. 17, 1979

[54] POWDER MATERIAL PROCESSING APPARATUS

[75] Inventors: Tsutomu Itoh, Tokyo; Munekazu Sakurai, Kitamoto; Masahiro Yamamoto, Chiba; Yasunari Okamoto, Tokyo, all of Japan

[73] Assignee: Onoda Cement Co., Ltd., Onoda, Japan

[21] Appl. No.: 756,910

[22] Filed: Jan. 4, 1977

[51] Int. Cl.[2] ..... H05B 5/02

[52] U.S. Cl. ..... 361/226; 361/227; 361/229

[58] Field of Search ..... 361/225–227, 361/229, 231, 233; 118/620, 621, 626, 627, 640; 239/15 AA, 15 V, 15 R, 15 AC

[56] References Cited

U.S. PATENT DOCUMENTS

| | | | |
|---|---|---|---|
| 3,841,264 | 10/1974 | Masuda | 118/621 X |
| 3,872,361 | 3/1975 | Masuda | 361/233 |
| 4,029,995 | 6/1977 | Itoh | 361/226 |

*Primary Examiner*—Harry E. Moose, Jr.

*Attorney, Agent, or Firm*—Price, Heneveld, Huizenga & Cooper

[57] ABSTRACT

An improved powder material processing apparatus is described herein, in which a plurality of wire-shaped electrodes are disposed within an imaginary plane at an equal interval and in parallel to each other. An insulator layer is interposed between the adjacent wire-shaped electrodes to prevent spark discharge from being generated by an A.C. high voltage applied between the adjacent wire-shaped electrodes. A silent discharge region is established between said adjacent wire-shaped electrodes, and positive and negative charges are separately given to the particles forming said powder material by making uncharged powder material pass through said silent discharge region, resulting in formation of powder material consisting of substantially equal numbers of positively charged particles and negatively charged particles, whereby control characteristics of the processed powder material can be greatly improved and the above-mentioned charging process can be effected continuously at a high efficiency.

13 Claims, 8 Drawing Figures

POWDER MATERIAL PROCESSING APPARATUS

Figure 1:
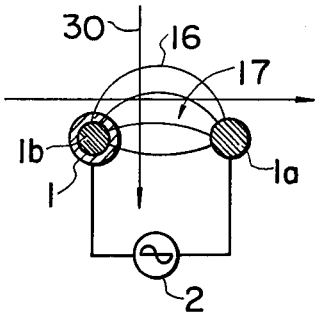

The present invention relates to a powder material processing apparatus for processing powder material having a high electric resistance such as, for example, pulverized epoxy resin, polyester resin, polyethylene resin, vinyl chloride resin, etc. and, additionally, various paints for electrostatic powder painting, to make the powder material easily controllable by an electric field device.

A device called an electric curtain for powder material processing such as repulsion, confinement, transportation, brushing off, etc. of charged particles by means of uneven alternating electric fields, has been heretofore known. In addition, a contact type electric field curtain of the type in which an exciter is added to these electric field curtain devices, has been also known. Further, a mono-polar type of electric field device has been already invented by the inventers of this invention. In order that these devices for controlling particles by means of the co-called uneven A.C. electric field operate effectively, it is required that the powder particles are charged. In the above-referred contact type electric field curtain device, even if the particles are not charged, the particles can be charged through contact charging by making contact with the so-called exciter, and thereby the performance of the device can be effectively achieved. However, this is effective only in the case where the amount of the particles being fed is very small, and one can say that generally to achieve such a performance is impossible.

The present invention has been worked out with an object of improving a nature of powder material so that the above-described various devices may effectively control a large amount of powder material by effectively charging the powder material through the processing of these particles in the apparatus according to the present invention. When a large amount of uncharged particles are fed to the contact type electric curtain device or the like, it cannot effectively achieve its performance unless the particles are charged.

In case that uncharged powder material is directly fed to the above-mentioned various devices in the prior art, either they cannot control the powder material at all or they can control it only a very little.

It is one object of the present invention to provide a powder material processing apparatus which can provide powder material consisting of a charged particle group and is easily controllable. Such powder material is free from the heretofore known disadvantages that the powder material is liable to be dispersed and is apt to adhere onto environmental surfaces as is the case where particles forming powder material are charged with mono-polar positive or negative charge.

Another object of the present invention is to provide a powder material processing apparatus, in which spark discharge upon processing powder material, is prevented and undesirable burning of the powder material can be obviated.

According to one preferred embodiment of the present invention there is provided a powder material processing apparatus, in which a plurality of wire-shaped parallel electrodes are disposed at a fixed interval, at least every other electrode is connected in common phase, and in which said at least one phase of wire-shaped electrodes are insulator coated electrodes. Two-dimensional silent discharge is induced by applying an A.C. high voltage to generate two-dimensionally distributed ions within said discharge generating region, and unprocessed powder material can be charged by forcibly making it pass through said region.

Above-mentioned and other features and objects of this invention will become more apparent by reference to the following description taken in conjunction with the accompanying drawings, in which:

FIG. 1 is an enlarged cross-section view of a part of two-dimensional silent discharge electrodes which form an essential part of a powder material processing apparatus embodying the present invention.

Figure 2:
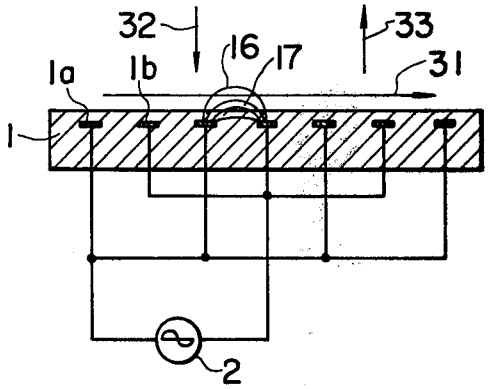
Figure 3:
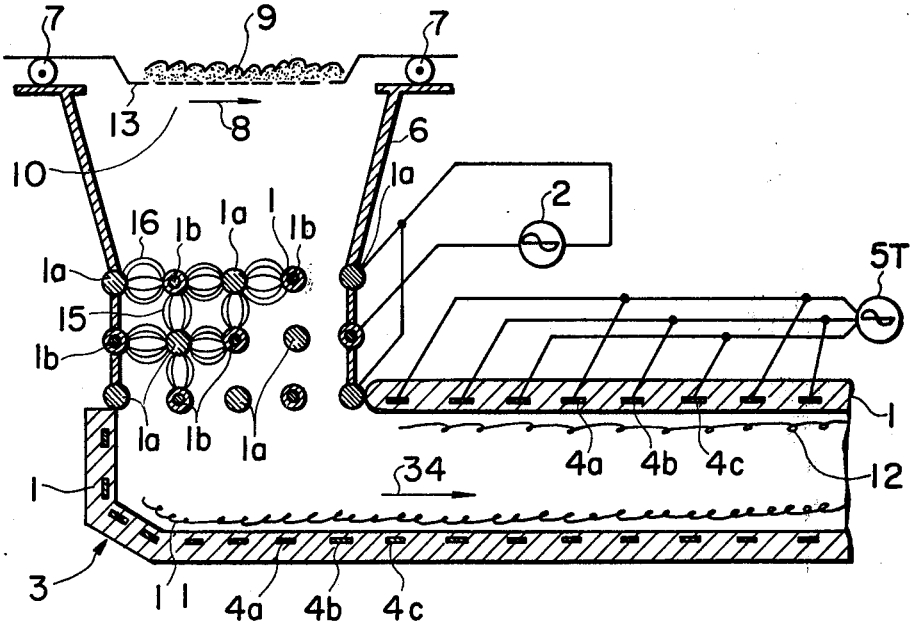
Figure 4:
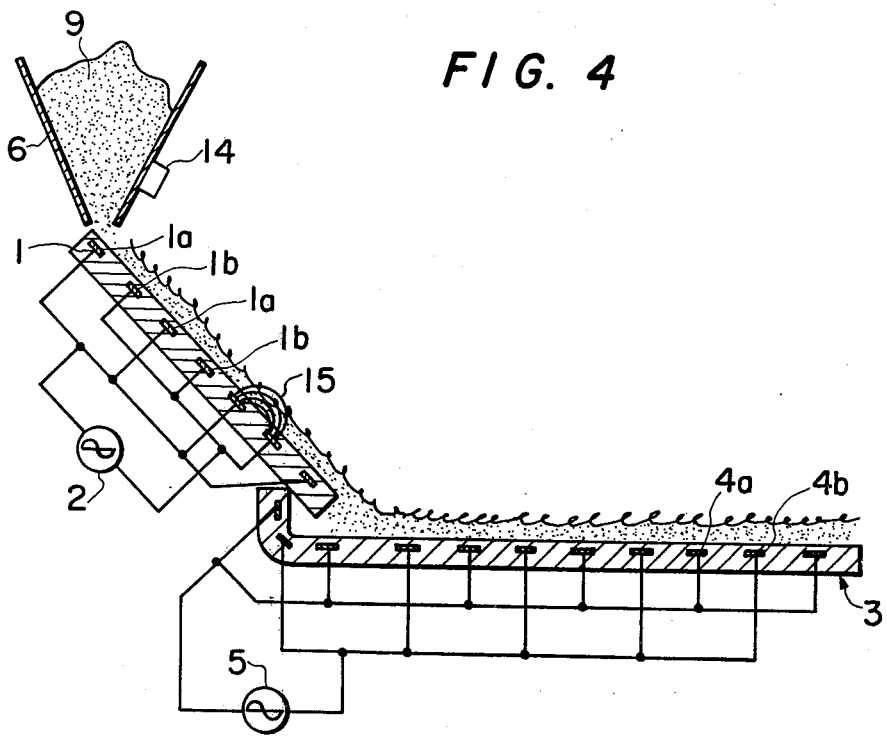
Figure 5:
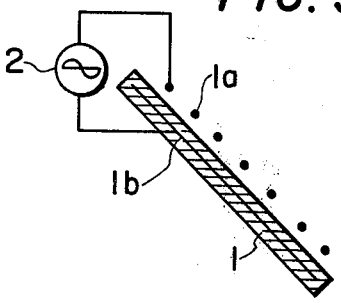
Figure 7:
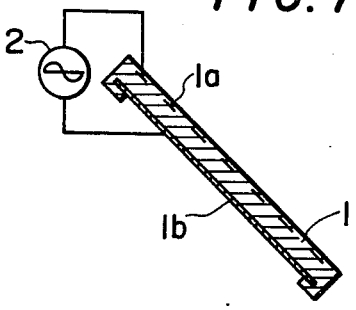
Figure 6:
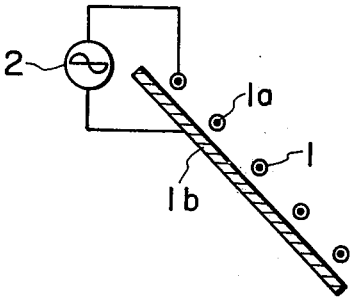
Figure 8:
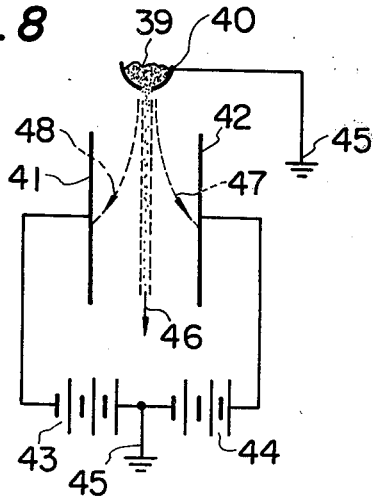

FIG. 2 is an enlarged cross-section view of modified two-dimensional silent discharge electrodes, FIG. 3 is a schematic cross-section view of a powder material processing apparatus according to one preferred embodiment of the present invention, FIG. 4 is a schematic cross-section view of a powder material processing apparatus according to another preferred embodiment of the present invention, FIGS. 5, 6 and 7 are longitudinal cross-section views of modified structures of the two-dimensional silent discharge electrodes forming an essential part of the apparatus shown in FIG. 4, and FIG. 8 is a schematic view of an experimental device for observing the fact that powder material processed by the apparatus according to the present invention shows an excellent dispersive property in an electric field device.

The powder material processing apparatus according to the present invention is characterized in that provision is made such that dispersed powder material is forcibly made to pass through a space where silent discharge exists. While various methods can be used to produce a space where silent discharge exists, according to the present invention basically the following method is employed. That is, as shown in FIG. 1, at least one of electrodes 1*a* and 1*b* made of conductors disposed in parallel to and apart from each other as opposed to each other, is coated with an insulator 1 to prevent spark discharge from occurring between the electrodes 1*a* and 1*b* directly through a space, and then an A.C. voltage is applied therebetween from a power supply 2. In that case, when an electric field strength in a space 17 in FIG. 1, as represented by lines of electric force 16, becomes higher than a spark voltage of a gas existing in this space, silent discharge would arise in space 17. In the powder material processing apparatus according to the present invention, powder material is forcibly made to pass through this space 17 in the direction of arrow 30 as by a gravity, wind force, centrifugal force, or the like while dispersing the powder material in the space 17. The powder particles are charged in both polarities by making positive and negative ions produced by the silent discharge existing in this space 17 adhere onto the powder particles, so that the powder particles which have passed through this space 17 can be given an electric charge such that the particles can be effectively controlled by an electric field device. In this case, the powder material could be forcibly made to pass through the space 17 in the direction of arrow 31 by the action of gravity, wind force, centrifugal force, or the like.

As an apparatus for producing a space where silent discharge exists, an electrode arrangement as shown in FIG. 2 would be thought of. That is, in the vicinity of a surface of an insulator layer 1 parallel wire-shaped electrodes 1*a* and 1*b* are embedded, with alternate ones of these electrodes being connected in the same phase, and an A.C. high voltage being applied to these parallel wire-shaped electrodes from a power supply 2. In this case, the alternate ones of the wire-shaped electrodes need not always be connected, but it is, of course, possible to connect every (n-1)-th electrodes together and to apply an N-phase A.C. high voltage to the respective phases. As will be apparent from FIG. 2, between adjacent electrodes 1*a* and 1*b* are formed lines of electric force 16 in the vicinity of the insulator layer 1. In this case, when an electric field strength in the space near to the surface of the insulator layer 1 has become higher than a spark voltage of a gas existing in this space, silent discharge would arise in the space 17. In case that such condition has been established, by forcibly making powder material flow in the direction of arrow 31 under existence of an appropriate force as represented by arrow 32 or 33, likewise the powder particles are charged in both polarities by positive and negative ions existing in this space 17 adhered onto the powder particles, so that the powder particles which have passed through this space 17 becomes effectively controllable by an electric field curtain device. In this case, as examples of the force represented by arrow 32 or 33, gravity, wind force, centrifugal force, or the like could be employed.

In the system for processing powder material by making use of silent discharge generated over an entire surface of a planar body as described above, because of the fact that the field represented by the lines of electric force 16 is an alternating electric field, particles which have been charged appropriately by passing through this region will oscillate along the outwardly convex curved lines of electric force 16 at the surface of this alternating field surface, and thereby the particles are subjected to repulsion forces which tend to keep them away from the surface, so that the particles float up. Consequently, the appropriately charged particles will float up leaving the surface of the insulator layer 1 due to the repulsion forces exerted upon the particles by the alternating electric field, and only uncharged particles remain on the surface of the insulator layer 1. Owing to this selection effect, charging efficiency of particles can be extremely enhanced. By effectively utilizing the selection effect it is possible to separate and collect only charged particles. In this case, very often the insulator layer 1 is used in an inclined state. with regard to the silent discharge generating surface to be used in the powder material processing apparatus according to the present invention, which, in principle, makes use of silent discharge generated in a two-dimensional form, various modifications could be made according to the principle of the invention, and some examples are illustrated in FIGS. 5, 6 and 7. FIGS. 5 to 7 will be described later.

Microscopically, the powder material processed in the powder material processing machine according to the present invention consists of both positively charged powder particles and negatively charged powder particles. Since both the above-referred contact type electric curtain device and mono-polar type electric curtain device can effectively exhibit their performances so long as the particles are charged, and since the performances do not depend upon the polarity of charging, by subjecting powder material to such provisional processing, the processed powdered material can attain the properties for making these electric curtain devices well exhibit their performances. However, in order to make powder material exhibit such properties and also make it retain such properties over a long period of time, it is necessary for the powder material to have an extremely high electrical resistance. But even in case the electrical resistance of the powder particles is low, with respect to powder material subjected to processing by the powder material processing apparatus according to the present invention, the powder material can be given properties for making the above-referred electric field curtain devices or other mono-polar electric field devices operate effectively, provided the processed powder material is fed to these devices immediately after the processing. Accordingly, the powder material processing apparatus according to the present invention is applicable to every powder material, although the holding time of the properties given to the powder material by the processing may vary, depending upon the powder material. When a powder material having an extremely high electrical resistance has been processed by the powder material processing apparatus according to the present invention, the powder material will be composed of particles bearing positive charge and those bearing negative charge substantially in equal proportions, so that the powder material, as a whole, does not scatter easily and becomes very easy to handle. In addition, if the processed powder material is dispersed again, these particles will hold a sufficient amount of electric charge for operating a contact type electric field curtain device or a monopolar electric field device over a long period of time, so that the processing method according to the present invention is very excellent as a method of processing powder material for effectively operating a contact type electric field curtain device or a mono-polar electric field device. In contrast, heretofore known pre-processing apparatus, in which powder material is processed while passing through a corona discharge space, is strictly limited with respect to its applicable field as a powder material pre-processing apparatus, because if an electrical resistance of the powder material is extremely high, the powder material processed by the known apparatus would be charged substantially in one polarity and would become ready to be dispersed due to repulsion between the powder particles. Furthermore, in a device for charging powder material by making use of corona discharge, often the electric field is greately distorted by space charge and other causes existing in the charging space and becomes liable to produce sparking. This becomes a great fault when combustible powder material is to be charged. However, the present invention provides a charging apparatus for powder material which has very high security, because in the charging device according to the present invention, sparking would never arise between the electrodes because of the existence of an insulator interposed between the electrodes of the respective phases. In addition, since the powder material processing apparatus according to the present invention does not use corona discharge at all for generating ions, structurally weak parts such as thin electrodes or sharply pointed electrodes do not exist in the apparatus, so that the electrodes can be constructed using a considerably more rugged and thick structure. Therefore, by arraying these electrodes in a zig-zag manner, it is possible to forcibly divert the direction of the air flow for sufficiently effecting stirring of powder and gas in a charging space, and thereby a very high charging efficiency can be attained.

Now one preferred embodiment of the present invention will be described in detail with reference to FIG. 3. In this figure, each of an electrode group 1*a* and an electrode group 1*b* consists of parallel rod-shaped electrodes arrayed in a direction perpendicular to the plane of the sheet, and in the illustrated embodiment, all the electrodes in the group 1*a* are connected in one common phase while all the electrodes in the group 1*b* are connected in the other common phase, and between these electrode groups 1*a* and 1*b* is applied an A.C. voltage from a power supply 2. In addition, in order to prevent spark discharge from occurring directly between the electrodes 1*a* and 1*b*, one of the electrode group (the group of electrodes 1*b* in this case) has all its electrode surfaces coated by an insulator layer 1 of appropriate thickness. The electrodes in the group 1*b* also could be coated likewise. In the illustrated apparatus, as will be apparent from the figure, the parallel wire-shaped electrodes are arrayed in three rows spaced apart in the vertical direction.

Above the silent discharge electrodes arranged in three rows, is disposed a hopper 6. A dispersive feeder 8 of powder material is mounted above the hopper 6, and uncharged powder material particles 9 in a bulk form are fed onto the dispersive feeder 8. Though the powder material feeder 8 could be constructed in various forms, in the structure shown in FIG. 3, the construction is such that the supplied powder material may ride on a sieve member 13 vibrating in the direction of arrow 8. The sieve member 13 is caused to vibrate in the direction of arrow 8 relative to the hopper 6 by means of wheels 7. Accordingly, powder material 9 slowly falls into a space 10 towards the electrode group in the lower portion of the space, while floating in a gas. Since an A.C. voltage is applied between the silent discharge electrode groups 1*a* and 1*b* from an A.C. power supply 2 so that sufficient silent discharge may exist between these electrodes, there exists a sufficient amount of positive and negative ions in the space between these electrodes where lines of electric force 15 and 16 extend. Therefore, powder material passing through the space between these electrodes attains positive and negative charge during the passing, and when it arrives at the top of an electric field curtain device 3 connected under the charging space, the powder material has attained electric charge enough to be well controllable by the electric field curtain device 3.

In the illustrated embodiment, gravity is shown as an example of a method for allowing the powder material to pass through the silent discharge space. More particularly, it has been well-known as a principle of the so-called electric field curtain device that since the lines of electric force 16 are lines of A.C. electric force curved in an upwardly convex manner, if the powder particles are appropriately charged unitary particles, they cannot pass through this electric field region. However, when the apparatus is constructed as described above and dispersed powder material particles are successively fed to the electrodes from above, even if the particles are charged, with respect to floating particles, gravity acts upon a particle positioned above a lower particle so that the upper particle exerts a downward pressure upon the lower particle by electric field action. Therefore, if a certain amount of particles stay on the electrodes, even charged particles can successively pass through the gap space between the electrodes owing to the pressure exerted by the upper particles. In addition, in a case similar to the illustrated embodiment, if the particles are fed while floating in a gas flow, then it is also possible to forcibly make the particles pass through the space where insulated discharge exists, by maintaining the flow velocity of the gas flow larger than the repulsion force exerted upon the charged particles by the lines of A.C. electric force 16. In one preferred embodiment, rod-shaped electrodes, each having a diameter of 3 mm and being coated with a polyethylene film of 0.5 mm in thickness, are disposed in parallel at an interval of 5 mm. By conveying particles at a wind velocity of 30 cm/sec. to 50 cm/sec. it was possible to make these particles pass through a silent discharge region for processing the particles. Furthermore, in case that appropriately charged particles are mixed in the particles being fed, it is possible to practice a method in which the appropriately charged particles only are preliminarily collected without making them pass through the silent discharge region by the action of the curved lines of A.C. electric force 16, while only the uncharged particles are processed by making them pass through the silent discharge region. The processing is finished by separately collecting the respective particle groups.

With reference to FIG. 3, in the conventional electric curtain device 3, parallel wire-shaped electrodes 4*a*, 4*b*, and 4*c* aligned on a plane perpendicular to the sheet of the drawing are embedded in an insulator layer 1 in the vicinity of its inner surface. Every third one of these parallel wire-shaped electrodes 4*a*, 4*b* and 4*c* is connected in common phase, and these electrodes are fed with voltages by a three-phase power supply 5T. Accordingly, along the inner surface of the insulator layer 1, there exists a traveling wave A.C. electric field traveling in the direction of arrow 34, and there exists a repulsion effect upon the charged particles. Accordingly, this insulator trough containing the wire-shaped electrodes 4*a*, 4*b* and 4*c* therein, forms a conveying device for charged particles inside the insulator layer 1. In the illustrated example, the width of the electric field curtain device 3 as measured in the direction perpendicular to the plane of the sheet is 10 cm, and the distance between the upper surface and the lower surface of the trough is 3 cm. In case that uncharged powder particles 9 were fed to this electric field curtain device 3 at a rate of 150 g/min. by means of the powder material feeder 8, if silent discharge was sustained in the space between the electrodes 1*a* and 1*b*, then the fed powder material could be conveyed by the electric field curtain device 3 through the transport channel delimited by boundaries 11 and 12 without any trouble. Whereas, if the same amount of powder material particles 9 were fed in the same manner while maintaining the voltage of the power supply 2 at 0 volts, the fed powder material particles 9 would immediately accumulate in the proximity of the bottom 11 of the hopper 6, and so, it would be impossible to convey the powder material particles 9. The powder material used in this case comprises polyethylene particles for electrostatic powder painting having an average diameter of 40 microns. The silent discharge electrodes 1*a* and 1*b* were rod-shaped electrodes made of a copper wire having a diameter of 3 mm and applied with polyethylene coating of 0.5 mm in thickness, which were arrayed in parallel at an interval of 5 mm. A voltage of 10,000 Volts was applied between these electrodes from the power supply 2. In addition, the insulator layer 1 of the electric field curtain device 3 was made of epoxy resin, electrodes 4*a*, 4*b* and 4*c* of 0.5 mm in width were embedded at a pitch of 5 mm in the insulator layer 1 at a depth of 0.5 mm from its inner surface, and the voltage applied to these electrodes was 3000 Volts. In this case, silent discharge did not arise along the inner surface of the electric field curtain device 3.

FIG. 4 illustrates another preferred embodiment of the powder material processing apparatus according to the present invention, in which reference numeral 1 designates an insulator layer disposed at an appropriate angle of inclination, which insulator layer 1 is disposed as directed to a direction perpendicular to the plane of the sheet. Uncharged powder material particles 9 stored in a hopper 6 are adapted to be fed to the top end of the powder material processing apparatus according to the present invention along its inclined surface by means of a powder feeding vibrator device 14 mounted to the hopper 6. In the portion of the insulator layer 1 near its surface, groups of conductor electrodes 1*a* and conductor electrodes 1*b* are respectively connected in common phases, and the circuit connection is constructed in such manner than an A.C. voltage is applied between the electrode groups 1*a* and 1*b* from the power supply 2. In this case, lines of electric force 15 formed between the electrodes 1*a* and 1*b* at the surface portion of the apparatus partly penetrate through the interior of the insulator layer 1, but the remaining part thereof leaks out of the surface of the insulator layer 1. When the electric field strength due to the leak-out lines of electric force becomes stronger than the spark voltage of the gas at the surface of the insulator layer 1, silent discharge arises over the entire surface of the insulator layer 1. The powder material 9 fed from the hopper 6 while sliding down along this surface where silent discharge is occurring, is charged up to an appropriate charged value by the positive and negative ions produced by the silent discharge occuring at the surface portion. The charged powder material particles are repelled from the surface of the insulator layer 1 due to the outwardly convex curved lines of electric force 15 existing in the space between the electrodes 1*a* and 1*b*, so that the charged particles float up and only the uncharged particles slide down along the surface of the apparatus. Therefore, the powder material particles which have been already charged would not stop the powder material particles which have not yet been charged from being charged. So thus, the apparatus according to the present invention has made it possible for the first time to charge a very large amount of powder material in both polarities by selecting an appropriate sliding distance.

In addition, the apparatus according to the present invention can effectively separate charged powder material particles from uncharged powder material particles and can collect them separately. Further, it is also possible to effectively charge the uncharged powder material particles by making them pass again through the apparatus according to the present invention.

When powder material is not sufficiently charged, for instance, unprocessed powder material fed to the above-described electric field curtain, it becomes necessary to apply an extremely high voltage to the electric field curtain device. When the applied voltage is high, strong ozonization will occur in the vicinity of the electrodes within the electric field curtain. Thus, available powder material cannot be obtained because of the hydrophilic nature even if ozone-resistive material is used even if absorption of water was prevented by applying hydrophobic coating to the material the adhesion phenomena of extra fine particles of the powder material will arise. Therefore, there was a problem that the lines of electric force hardly appeared outside of the insulator layer 1. However, it has been found that all such problems could be resolved by operating the electric field curtain device at a lower voltage.

With reference to FIG. 8, electrodes 41 and 42 are disposed in an opposed relationship, and high voltage sources 43 and 44 having their midpoint grounded are connected to these electrodes. If powder material 39 is put in a grounded metallic container 40 having an opening at its bottom and is allowed to fall through the opening, then unprocessed powder material falls without dispensing as shown by an arrow 46, but powder material which has been processed by the powder material processing apparatus according to the present invention disperses as shown by arrows 47 and 48 and adheres onto the positive and negative electrodes at high voltages equally in amount, so that the processed powder material is considered to be powder material consisting of substantially equal amounts of positively charged particles and negatively charged particles. Because of strong adhesion between the positively charged particles and the negatively charged particles in the powder material, the processed powder material lacks a dispersing nature for a long period of time and is thus convenient in handling, and yet in an electric field device it exhibits a dispersing nature and thus becomes easily controllable powder material.

Accordingly, if the powder material processed by the apparatus according to the present invention is fed into an electric field curtain device 3 driven by an A.C. power supply 5, this electric field curtain device 3 can apply actions such as repulsion, transportation, confinement, etc. to the powder material being fed over a long period time in a safe manner, even with such low voltage that silent discharge does not occur on the surface. With regard to the construction of the electrode structure in the powder processing apparatus, various modifications could be made as shown in FIGS. 5, 6 and 7. In any one of these modifications, the structure is such that an insulator layer 1 is surely interposed between the electrodes 1*a* and 1*b*, so that spark discharge would not occur and powder material can advantageously slide down between the electrodes. Especially in the modified structures shown in FIGS. 5 and 6, if the electrode 1*a* is allowed to vibrate under the action of electrostatic forces by holding the electrode 1*a* of thin wire shape only at its opposite ends, then sliding of the powder material can be realized more smoothly, and this often provides a very effective action upon stable operation of the device. It is to be noted that in FIGS. 4, 5, 6 and 7 the insulator layer 1 need not be formed in a plane but it could be formed in a conical shape or in a cylindrical shape. In this case, as a matter of course, besides gravity, it is possible to lightly urge the powder material onto the surface of the insulator layer 1 with an appropriate force such as a centrifugal force generated by rotating the insulator layer 1 itself or a centrifugal force generated by producing revolving motion of a gas along the surface of the insulator layer 1.

Describing in more detail the first preferred embodiment shown in FIG. 3, metallic electrodes of 3 mm in diameter are disposed in parallel at an interval of 5 mm. Every one of these electrodes to be insulated has its surface coated with a polyethylene film of 0.3 mm in thickness. These electrode arrays are arranged in three stages. Powder material dispersed by a sieve is allowed to fall through the gap space between these electrodes under the action of gravity, and an A.C. voltage of 10,000 Volts at 50 Hz is applied between these electrodes to generate silent discharge therebetween. Polyethylene powder for electrostatic powder painting which has been processed under the above-mentioned condition, does not accumulate on the surface of the electric field device 3, even in case there has been applied to the electric field device 3 from the power supply 5 such a low voltage that at the surface of the electric field device 3 for receiving this powder material silent discharge may not occur at all. Thus, it is possible to convey continuously the powder material being fed. In the structure shown in FIG. 4, an epoxy resin plate of 3 mm in thickness is employed as the insulator layer 1, and electrodes of 10$\mu$ in thickness and 1 mm in width are disposed at a pitch of 5 mm at a depth of 0.5 mm from the surface. Powder material has been processed by applying a voltage of 9000 Volts between the electrodes, and improvements in quality of the powder material similar to the case of FIG. 3 have been observed. It was experimentally confirmed that these improvements in quality hardly show a significant change even when several tens of hours have passed since the processing of the powder material.

Since the present invention has the above-described features, if powder material is fed to the above-described electric curtain devices, the contact type electric field curtain devices or the mono-polar electric field devices after it has passed through the powder material processing apparatus according to the present invention, then the powder control capability of these devices can be enhanced by a factor of several to several tens. Furthermore, the powder material processed by the powder material processing apparatus according to the present invention need not be always fed to said various devices immediately after the processing, because it is a remarkable characteristic feature of the apparatus according to the present invention that although a certain degree of difference may exist, depending upon varieties of powder material, the improved properties of the powder material can be effectively held over several tens of hours or more.

Since many changes could be made in the above construction and many apparently widely different embodiments of this invention could be made without departing the scope thereof, it is intended that all matter contained in the above description or shown in the accompanying drawings shall be interpreted as illustrative and not in a limiting sense.

We claim:

1. A powder material processing apparatus comprising:

a charging zone defined by at least one wall including a passageway adjacent thereto;

an array of elongated conductors extending in parallel relationship to and spaced from one another, said conductors extending transversely with respect to said passageway;

an A.C. power supply coupled to said electrodes with alternate electrodes coupled to opposite polarity terminals of said A.C. power supply to apply an A.C. voltage to said conductors of a magnitude to apply a bi-polar charge to powder by generating a silent A.C. discharge between said conductors; and means for passing powder material through the region where said silent discharge is generated.

2. A powder material processing apparatus as defined in claim 1, in which said conductors comprise wire-shaped electrodes and at least one of mutually adjacent wire-shaped electrodes is coated with insulating material.

3. A powder material processing apparatus as defined in claim 1, in which said conductors are arrayed in a cylindrical passageway for powder material along a plane transverse of the axis of said cylindrical passageway.

4. A powder material processing apparatus as defined in claim 1, in which said conductors are arrayed in a cylindrical passageway for powder material along a plane transverse of the axis of said cylindrical passageway, and said array of conductors are provided in multiple stages along the axial direction of said cylindrical passageway.

5. A powder material processing apparatus as defined in claim 1, in which said conductors are arrayed along a surface of a base that is inclined with respect to a horizontal plane.

6. A powder material processing apparatus as defined in claim 1, in which said conductors are arrayed in a surface portion of an insulator base along its surface that is inclined with respect to a horizontal plane.

7. A powder material processing apparatus as defined in claim 1, in which said conductors are arrayed outside of an insulator base along its outer surface that is inclined with respect to a horizontal plane.

8. A powder material processing apparatus, in which two or more wire-shaped electrodes are disposed within an imaginary surface at spaced intervals and in parallel to each other, an A.C. high voltage supply coupled to said electrodes for applying an A.C. voltage to said electrodes to establish a stratified region where a silent A.C. discharge exists along the electrode imaginary surface, and powder material is processed by passing dispersed powder material through this region at a predetermined velocity, said A.C. supply coupled to said electrodes to provide a bi-polar charge to powder material passing through said region.

9. A powder material processing apparatus comprising a cylindrical wall for introducing and guiding powder material dispersed in a gas, and wire-shaped electrodes having an insulative coating thereon which are arrayed in parallel to each other and substantially at equal intervals along a plane that is transverse of the axis of said cylindrical wall and means for applying only a high A.C. voltage which can induce A.C. silent discharge between adjacent ones of said electrodes to charge said powder material with positive and negative polarities.

10. A powder material processing apparatus comprising a base of insulator material having an upwardly inclined smooth surface, a feeder at an upper end of said inclined smooth surface for feeding powder material in a stratified form, wire-shaped electrodes having an insulator coating, said electrodes disposed substantially in parallel to each other and at equal intervals on the surface of the base and oriented in a direction substantially at right angles to the direction of the gradient of the surface of the base, and means for applying only an A.C. high voltage between said wire-shaped electrodes which can induce an A.C. silent discharge between adjacent ones of said electrodes to provide a bi-polar charge to powder material.

11. A powder material processing apparatus, in which a plurality of wire-shaped electrodes are disposed in parallel and at equal interval within an upper surface portion of an inclined insulator layer, a planar electrode disposed at a lower portion of said insulator layer, only an A.C. high voltage is applied between these electrodes to produce a region where silent discharge exists, and means for passing dispersed powder material through said region to be charged in positive and negative polarities.

12. A powder material processing apparatus comprising a base of insulator material having an upwardly inclined smooth surface, a feeder at an upper end of said inclined smooth surface for feeding powder material in a stratified form, wire-shaped electrodes having an insulator coating, said electrodes disposed substantially in parallel to each other and at equal intervals within an imaginary plane spaced from said surface and parallel thereto, and oriented in a direction substantially at right angles to the direction of the gradient of said surface of said base, and means for applying only an A.C. high voltage between said wire-shaped electrodes which can induce an A.C. silent discharge between adjacent ones of said electrodes to provide a bi-polar charge to powder material.

13. A powder material processing apparatus, in which a plurality of wire-shaped electrodes are disposed in parallel and at equal intervals outside of an upper surface portion of an inclined insulator layer, a planar electrode disposed at a lower portion in said insulator layer, means for applying only an A.C. high voltage between said wire-shaped and planar electrodes to produce a silent discharge region, and means for passing dispersed powder material through said region to be charged in positive and negative polarities.

* * * * *